US008736415B2

(12) United States Patent
Xu et al.

(10) Patent No.: US 8,736,415 B2
(45) Date of Patent: May 27, 2014

(54) AMORPHOUS ALLOY STEREO WOUND-CORE

(75) Inventors: Kaixuan Xu, Kaiping (CN); Xianqing Guo, Kaiping (CN)

(73) Assignee: Guangdong Hai Hong Co., Ltd. (CN)

( * ) Notice: Subject to any disclaimer, the term of this patent is extended or adjusted under 35 U.S.C. 154(b) by 0 days.

(21) Appl. No.: 13/704,725

(22) PCT Filed: Oct. 31, 2011

(86) PCT No.: PCT/CN2011/081570

§ 371 (c)(1), (2), (4) Date: Dec. 17, 2012

(87) PCT Pub. No.: WO2012/163034

PCT Pub. Date: Dec. 6, 2012

(65) Prior Publication Data

US 2013/0106561 A1 May 2, 2013

(30) Foreign Application Priority Data

May 27, 2011 (CN) ..... 2011 1 0140001

(51) Int. Cl.
*H01F 27/24* (2006.01)

(52) U.S. Cl.
USPC ..... 336/234

(58) Field of Classification Search
USPC ..... 336/214–215, 212, 233–234
See application file for complete search history.

(56) References Cited

U.S. PATENT DOCUMENTS

2013/0093559 A1* 4/2013 Xu ..... 336/210

FOREIGN PATENT DOCUMENTS

| | | |
|---|---|---|
| CN | 99114376.0 | 12/2000 |
| CN | 01274212.0 | 10/2002 |
| CN | 01254231.8 | 5/2003 |
| CN | 02261926.7 | 7/2003 |
| CN | 200620046097.0 | 10/2007 |
| CN | 200710011167.8 | 10/2008 |
| CN | 202067640 | 12/2011 |
| DE | 2526502 | 7/1974 |
| RO | 107325 | 10/1993 |

* cited by examiner

*Primary Examiner* — Tuyen Nguyen
(74) *Attorney, Agent, or Firm* — Winthrop & Weinstine, P.A.

(57) ABSTRACT

The invention provides an amorphous alloy stereo wound-core, comprising three structurally identical amorphous alloy made square frames; the cross section of the sides of the frames is in an approximately semi-circular or semi-polygonal shape; the frames have semi-circular cross sections and uniform thicknesses; the vertical sides of every two adjacent frames fit together fixedly to form a core pillar, the horizontal sides of the frames form iron yokes; the cross section of each core pillar has a circular or regular-polygonal shape. With this structure, the magnetic conduction direction of the amorphous alloy is completely consistent with the magnetic circuit direction of the core, and its working vibration is small. This core structure guarantees balanced three-phase power supply and largely reduces the magnetic resistance and excited current. There is no seam in the amorphous alloy stereo wound-core, so there is no area with high energy consumption. In this way, the advantages of the amorphous alloy on high magnetic conduction can be fully realized; the loss caused by an air gap in a seam is minimized. On the basis of the very low no-load loss of the conventional amorphous alloy, the present invention can further reduce the loss by 20% or more.

1 Claim, 2 Drawing Sheets

AMORPHOUS ALLOY STEREO WOUND-CORE

TECHNICAL FIELD

This invention is in the field of power equipment, and particularly relates to an amorphous alloy stereo wound-core.

BACKGROUND

Energy saving is a state policy necessary for a country to establish an energy-saving society. Because of the prominent advantages of energy saving and environmental protection, the amorphous alloy transformers are widely accepted by users, and become a new ideal type of distribution transformers. Currently for the existing amorphous alloy transformers in the market, the three-phase five-leg and three-phase three-leg core structures are commonly adopted. Comparing these two conventional amorphous alloy iron core structures, the three-phase three-leg iron core structure could be deemed as an updated version of the three-phase five-leg core structure, with relatively smaller volume, less weight, and less production time. However, the cross sections of both structures are in a rectangular shape, the design of the transformer is thus restricted by the width of the amorphous alloy materials used, making the design and the manufacture inflexible. In addition, these types of core structure make the transformer with higher weight, higher cost, bigger volume and longer processing time.

Theoretically, the three-phase five-leg and three-phase three-leg core structures are a planar structure, making the magnetic circuit length of each core pillar different. Thus, the balance of three-phase power supply cannot be guaranteed. In addition, the occurrence of seams in the upper and lower iron yokes causes a high energy consuming area around the seams, so that the potential of the amorphous alloy sheets on high magnetic conductibility cannot be fully realized. Furthermore, the air gap formed in the seams increase the corresponding loss. Last but not least, the core and winding with a rectangular structure can reduce the ability of the products to withstand short-circuit.

THE SUMMARY OF THE INVENTION

The aim of this invention is to provide an amorphous alloy stereo wound-core with lower working vibration and lower excited current, so as to overcome the shortcomings of the existing technologies.

The invention is realized through an amorphous alloy stereo wound-core, consisting of three structurally identical amorphous alloy single frames, which are in a square shape, wherein the cross section of the sides of the frames is in an approximately semi-circular or semi-polygonal shape; the single frames are semi-circularly and evenly distributed, the vertical sides of every two adjacent frames fit together fixedly to form a core pillar, the horizontal sides of the frames form iron yokes, the cross section of the core pillars is in circular or regular-polygonal shape.

The amorphous alloy stereo wound-core provided herein is characterized in that the single frames are made of trapezium amorphous alloy strips by winding from inside to outside consecutively.

The invention provides an amorphous alloy stereo wound-core. With the structure provided, the magnetic conduction direction of the amorphous alloy strips used is completely consistent with the magnetic circuit direction of the core; during working the vibration is small, so that the noise problem of the conventional amorphous alloy core can be solved. The magnetic circuits of the three-phase core are completely equal, this guarantees the balance of the three-phase power supplying, and largely reduces the magnetic resistance and excited current. There exists no seam in the amorphous alloy stereo wound-core, so there is no high energy consuming area. In this way, the advantages of the amorphous ally on high magnetic conduction can be fully realized, and thus the loss caused by air gap in seam is minimized. On the basis of the very low no-load loss of the conventional amorphous alloy, the present invention can further reduce the loss by 20% or more.

DETAILED DESCRIPTIONS OF THE EMBODIMENTS

Detailed descriptions for the embodiments of the invention will be made with reference to the drawings.

Figure 1:
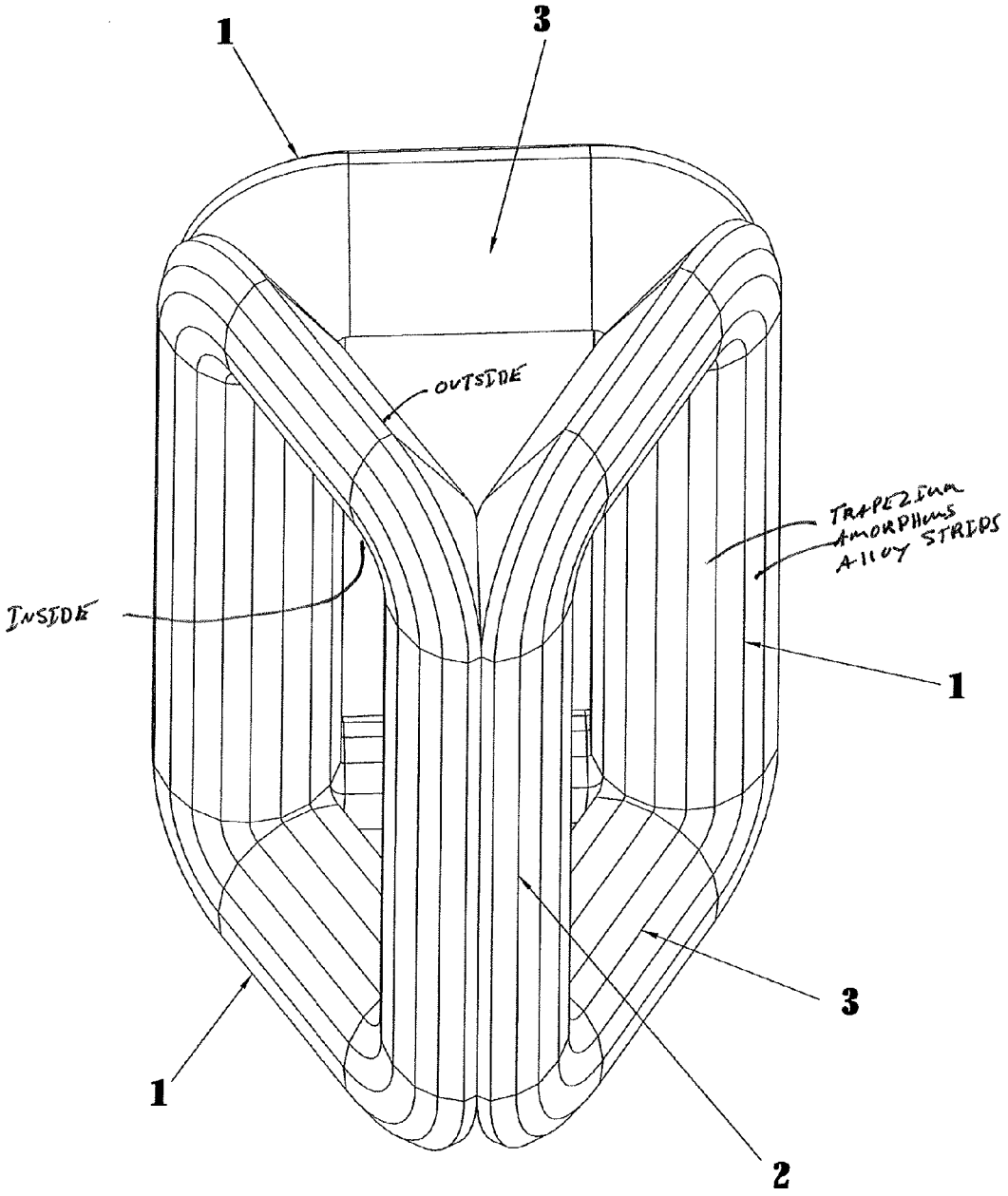
FIG. 1 is a spatial view of the invention.

As shown in FIG. 1, the amorphous alloy stereo wound-core provided comprising three amorphous alloy made single frames 1 which are identical in structure and in a square shape. Each frame 1 is made of several trapezium strips wound in sequence consecutively. The cross section of the sides of the single frames 1 is in a semicircular or semi-polygonal shape.

Figure 2:
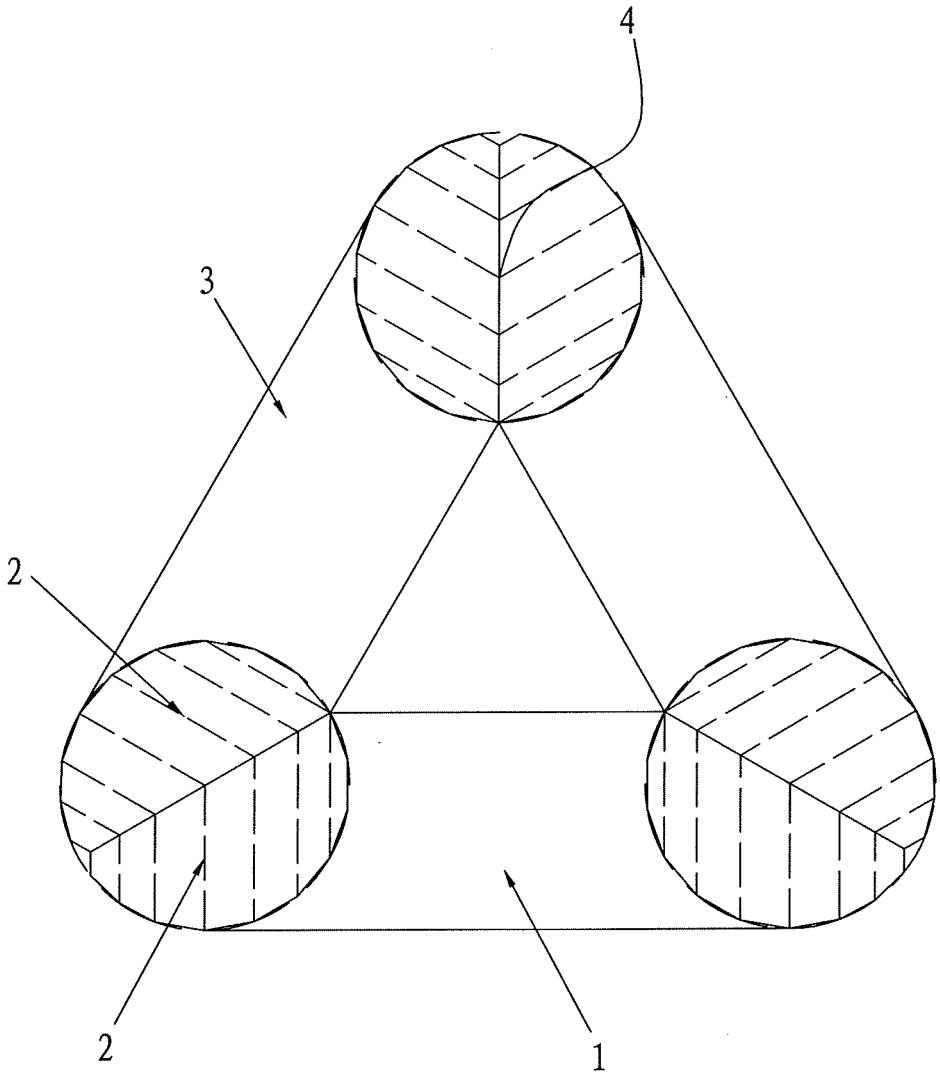
FIG. 2 is a sectional view of the invention.

The single frames 1 are circularly and evenly distributed. The vertical sides (2) of every two adjacent frames 1 fit together fixedly to form a core pillar 4. The horizontal sides of the frames 1 form iron yokes 3. As FIG. 2 shows, the cross section of each core pillar 4 is in a circular or polygonal shape.

Each single frame 1 is made of trapezium amorphous alloy strips wound from inside to outside consecutively.

Each single frame 1 is made of several trapezium amorphous alloy strips wound from inside to outside consecutively, there exists no seam. Package processing technique is adopted to process the amorphous alloy strips, and thus the utilization rate of material can reach 100%.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims which are to be accorded with the broadest interpretation so as to encompass all such modifications and similar structure.

The invention claimed is:

1. A seamless amorphous alloy stereo wound core, comprising: three structurally identical seamless amorphous alloy single frames having a square shape and an approximately semi-circular or semi-polygonal cross-sectional shape with uniform thicknesses, the single frames further comprising vertical sides and horizontal sides and formed from trapezium amorphous alloy strips wound from inside to outside consecutively, wherein the vertical sides of every two adjacent single frames fit together fixedly to form a core pillar and the horizontal sides of the seamless amorphous alloy single frames form yokes.

* * * * *